US005704501A

United States Patent [19]

Valyi

[11] Patent Number: 5,704,501

[45] **Date of Patent: *Jan. 6, 1998**

[54] CONTAINER CLOSURE ASSEMBLY INCLUDING BARRIER LAYER WITH A CRYSTALLIZED, BRITTLE WEAKENED PORTION

[75] Inventor: Emery I. Valyi, Katonah, N.Y.

[73] Assignee: EV Family Limited Partnership, New York, N.Y.

[ * ] Notice: The portion of the term of this patent subsequent to Jul. 5, 1994, has been disclaimed.

[21] Appl. No.: 384,024

[22] Filed: Feb. 6, 1995

[51] Int. Cl.[6] ..... B65D 17/44

[52] U.S. Cl. ..... 215/232; 215/258

[58] Field of Search ..... 215/232, 250, 215/228, 257; 220/258, 278, 277, 359; 212/12.2

[56] References Cited

U.S. PATENT DOCUMENTS

| | | | |
|---|---|---|---|
| 3,938,898 | 2/1976 | Reitknecht | 401/183 |
| 4,044,941 | 8/1977 | Knudsen | 220/258 |
| 4,337,116 | 6/1982 | Foster et al. | 162/158 |
| 4,360,116 | 11/1982 | Humphrey | 220/586 |
| 4,580,682 | 4/1986 | Gorski et al. | 220/258 X |
| 4,588,099 | 5/1986 | Diez | 215/232 |
| 4,813,578 | 3/1989 | Gordon et al. | 220/258 X |
| 4,925,044 | 5/1990 | Hembert | 220/589 |
| 4,930,646 | 6/1990 | Emslander | 215/232 |
| 5,082,136 | 1/1992 | Schumann | 220/258 |
| 5,090,582 | 2/1992 | Art et al. | 220/258 X |
| 5,101,993 | 4/1992 | Nairn et al. | 215/232 |
| 5,152,428 | 10/1992 | Gordon et al. | 215/232 X |
| 5,161,728 | 11/1992 | Li | 228/124 |
| 5,205,430 | 4/1993 | Valyi | 220/258 X |
| 5,316,603 | 5/1994 | Akazawa et al. | 220/359 X |

FOREIGN PATENT DOCUMENTS

| | | |
|---|---|---|
| 1417219 | 10/1965 | France . |
| 257496 | 9/1926 | United Kingdom . |

*Primary Examiner*—Stephen Cronin
*Attorney, Agent, or Firm*—Bachman & LaPointe, P.C.

[57] ABSTRACT

A container closure assembly including a container, a barrier layer and a closure member. The barrier layer and closure member completely cover the access opening to the container and the barrier layer includes a weakened portion thereof comprising a crystallized, brittle portion therein which is broken open on removing the closure member.

17 Claims, 3 Drawing Sheets

CONTAINER CLOSURE ASSEMBLY INCLUDING BARRIER LAYER WITH A CRYSTALLIZED, BRITTLE WEAKENED PORTION

BACKGROUND OF THE INVENTION

The present invention deals with a container closure assembly including a tamper proof closure and a barrier layer, and a method for obtaining same.

It is highly desirable to provide a container with a tamper-evident closure capable of being easily opened and reclosed without the use of a tool and also incorporating a gas permeation barrier, particularly when it is necessary to maintain the integrity of the contents of the container, as for example carbonated beverages. Thus, the closure should at least in part include a gas barrier layer in order to maintain the integrity of the container contents prior to opening. In addition, the closure should have the ability of showing whether or not it has been damaged or tampered with and it should also be sufficiently reclosable to avoid contamination of the contents after the opening of the container.

Heretofore, it has been difficult to accomplish the foregoing, especially with both plastic and metal closures, suitable for plastic containers and metal cans, respectively. It is clearly advantageous to utilize a closure as aforesaid, usually made of the same material as the container, but also with other combinations, e.g., a plastic closure for a metal can. For greater convenience in recycling, the closure and container materials should be the same.

It is also desirable to provide a container closure assembly as aforesaid which is easy to prepare commercially and which is convenient and easy to use by the consumer.

U.S. Pat. No. 5,325,976 to Valyi et al., patented Jul. 5, 1994, describes a container closure assembly including a plastic container, a barrier layer and a closure member. The barrier layer and closure member completely cover the access opening to the container and the barrier layer includes a weakened portion or zone thereof which is broken open on removing the closure member. It is desirable to provide an improved assembly with a convenient and expeditious formation of the weakened portion.

Accordingly, it is a principal objective of the present invention to provide a container closure assembly including a barrier layer, wherein the closure is resistant to gas permeation, is tamper-evident and is capable of being easily opened and reclosed.

It is a still further object of the present invention to provide a closure assembly as aforesaid which is easy to prepare, inexpensive and easy to use in practice.

Further objects and advantages of the present invention will appear hereinbelow.

SUMMARY OF THE INVENTION

In accordance with the present invention, the foregoing objects and advantages are readily obtained.

A container closure assembly is provided in accordance with the present invention including: a container having a container neck and a rim portion defining an access opening for the container; a plastic barrier layer having a rim and a central portion completely covering the access opening and with the barrier layer rim portion hermetically attached or adhered to said container, including a weakened portion of said barrier layer in the central portion of the barrier layer comprising a crystallized, brittle portion in the barrier layer central portion; a removable closure member adapted to cover said container access opening and barrier layer and engaging said barrier layer, said closure member intimately contacting said barrier layer when said closure member is removed by twisting; whereby removal of the closure member by twisting breaks the barrier layer at the weakened portion and opens the container. Preferably, the weakened portion is adjacent the barrier layer rim portion. The barrier layer is preferably polyethylene terephthalate (PET).

In a preferred embodiment, the closure and the barrier layer include stepped portions adjacent one another over the access opening, with the stepped portions extending either outwardly away from the access opening or inwardly towards the access opening. Preferably also the barrier layer stepped portion includes corner portions, as for example, the barrier layer stepped portion defining a hexagonal configuration. Thus, on twisting the closure member to remove same, the closure member places the stepped portion of the barrier layer under torsion breaking the barrier layer at the weakened portion.

The method of the present invention for providing a closure assembly, comprises: providing a container having an access opening therein; covering the access opening with a plastic barrier layer having a central portion and attached to the container; providing a weakened portion in the barrier layer central portion by forming a crystallized, brittle portion therein; and covering the container access opening and barrier layer with a closure member; wherein the closure member intimately contacts the barrier layer when the closure is removed by twisting, whereby removal of the closure member by twisting breaks the barrier layer at the weakened portion and opens the container.

Further features and advantages of the present invention will appear hereinbelow.

BRIEF DESCRIPTION OF THE DRAWINGS

The present invention will be more readily understandable from a consideration of the following illustrative and partly schematic drawings wherein.

DETAILED DESCRIPTION

Figure 1:
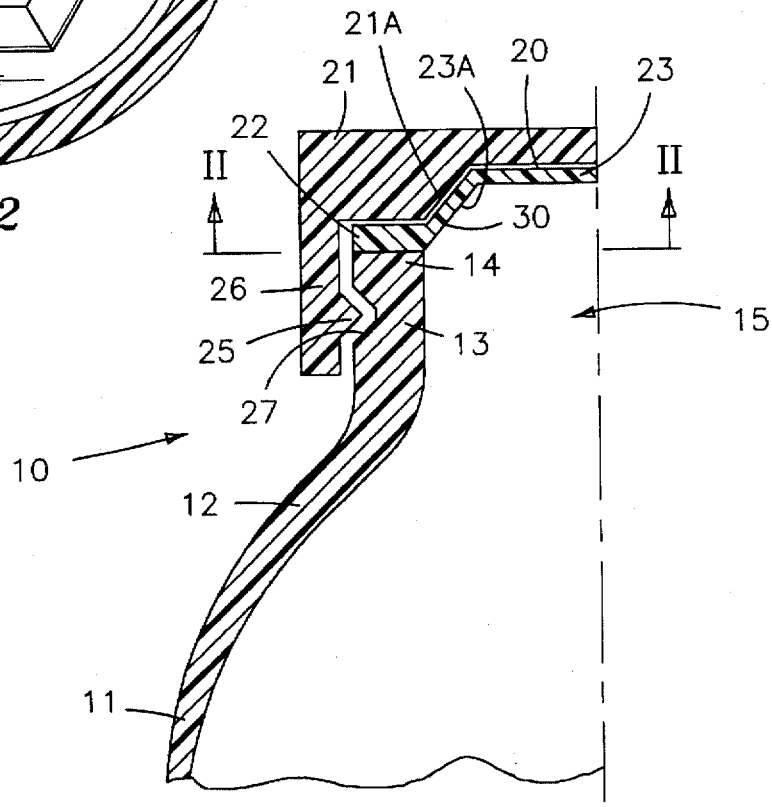
FIG. 1 is a partial sectional side view of a container closure assembly of the present invention.

FIG. 1 shows a partial sectional side view of container 10 having a container side wall 11 extending upwardly from a container bottom (not shown), container shoulder 12 extending upwardly from the container side wall, container neck 13 extending upwardly from the shoulder portion, and terminating in a container rim portion 14 defining an access opening 15 for container 10. The container 10 may be made of a plastic material, as polyethylene terephthalate (PET), or metal, as aluminum.

The closure assembly includes a barrier layer 20 and a closure member 21. The barrier layer may be made of the same plastic as the container having at least the same resistance to gas permeation as the container. Thus, if the container is made of the types of PET normally used for beverage bottles, the barrier layer may be made of the same grade of PET or one that is more permeation resistant, e.g., due to high crystallinity, or it may contain EVOH, both of which are compatible with the first mentioned PET for recycling. The closure member must be made of a rigid material and if the closure member is made of plastic it may be made transparent so that the barrier layer can be seen. The barrier layer may be made by thermoforming or injection molding.

Barrier layer 20 has a rim portion 22 and a central portion 23 and completely covers access opening 15. Rim portion 22 of barrier layer 20 is hermetically attached to container rim 14 to provide a gas impervious closure attachment for the unopened container.

Removable closure member 21 is provided over container 10 and covering the container rim and a portion of the container neck as well as the barrier layer. Closure member 21 may have a snap ring 25 positioned on the inside of descending closure member leg 26 and engaging recess 27 in container neck 13 so that the closure member can be snapped in place and simply removed by snapping the closure off or by twisting.

Figure 4:
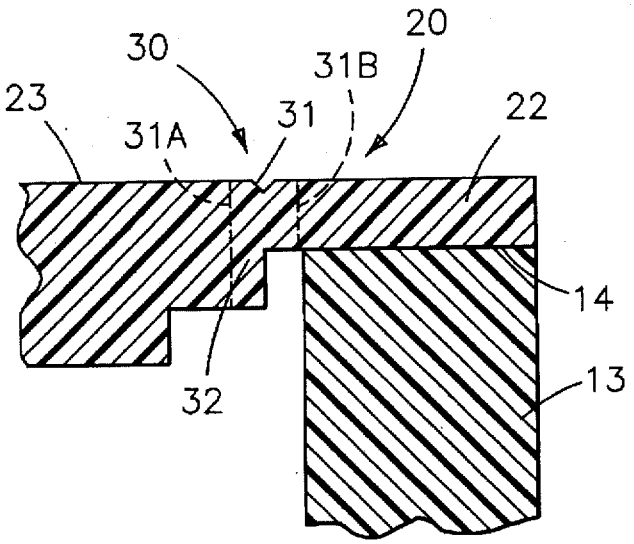
FIG. 4 is a partial enlarged sectional side view of a barrier layer-container interface.
Figure 9:
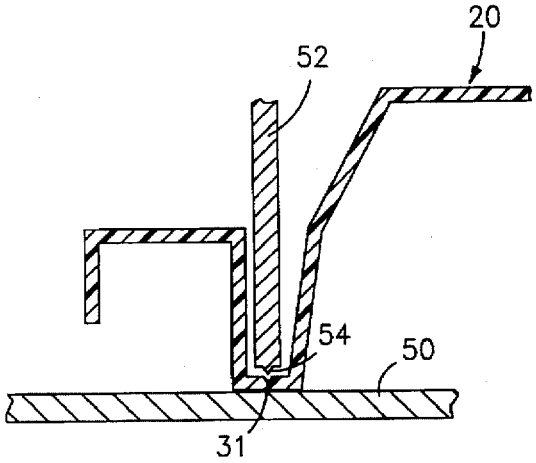
FIG. 9 is a schematic view of the formation of a weakened zone.

As shown in FIG. 1, barrier layer central portion 23 includes a stepped portion 23A extending outwardly, away from access opening 15. Similarly, closure member 21 includes a corresponding stepped portion 21A also extending outwardly away from access opening 15. In addition, barrier layer 20 includes a weakened portion 30 in the barrier layer central portion 23 spaced inwardly of barrier layer rim portion 22. The weakened portion 30 is clearly shown in FIG. 4 and may include a notch 31 to facilitate breaking of the weakened portion such as is shown in FIG. 4. Lines 31A and 31B in FIG. 4 show the boundary of weakened portion 31. The weakened portion for the plastic barrier layer is prepared by suitable treatment of the plastic barrier layer. Thus, barrier layer 20 should be made of a polymer that may be rendered brittle by suitable treatment. For example, in the preferred embodiment the barrier layer is made of PET which exhibits relatively low crystallinity, by pressure molding or forming from a sheet or film. In that state the PET is reasonably ductile and impact resistant. The PET is then heated along a zone that corresponds to the intended weakened zone, such as along weakened zone 30 clearly shown in FIG. 4 so as to induce extensive crystallization within the confines of the weakened zone. This is shown schematically in FIG. 9 wherein formed barrier layer 20 is placed on a platen 50 and heating tool 52 is placed in heating relationship with weakened zone 30. The heating tool 52 may if desired include a flange 54 for formation of notch 31 simultaneously with the heating step. Alternatively, one may if desired utilize a partly perforated notch or discontinuity as disclosed in copending application Ser. No. 08/221,567.

Other polymers than PET may naturally be used, such as nylon, polycarbonates and other polyethers.

It is well known that brittleness of PET increases with increased crystallinity. In accordance with the present invention, heating is continued until a level of crystallinity in excess of 30% is obtained.

Crystallization may be induced by other thermal processes, e.g., mechanically, i.e., high, localized deformation as may occur in coining with a relatively sharp tool.

As indicated above, while such a crystalline region has sufficient brittleness to fracture upon twisting off closure member 21, its effect may be enhanced by providing a notch 31 in the weakened portion. Fracture will reliably occur when the barrier member and closure member are twisted as disclosed in U.S. Pat. No. 5,325,976.

Figure 3:
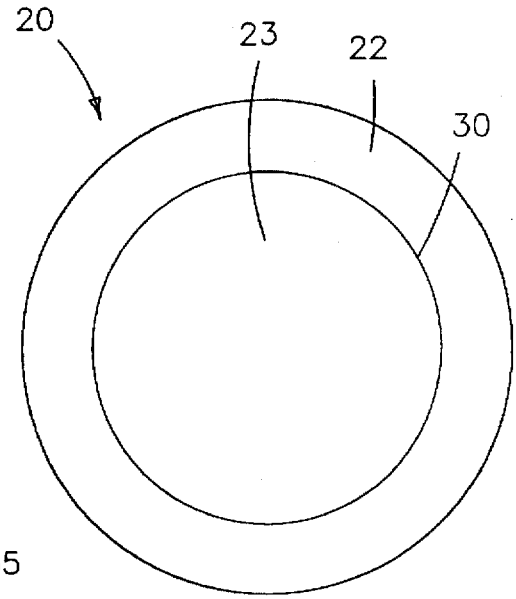
FIG. 3 is a top view of an injection molded barrier layer of the present invention.
Figure 2:
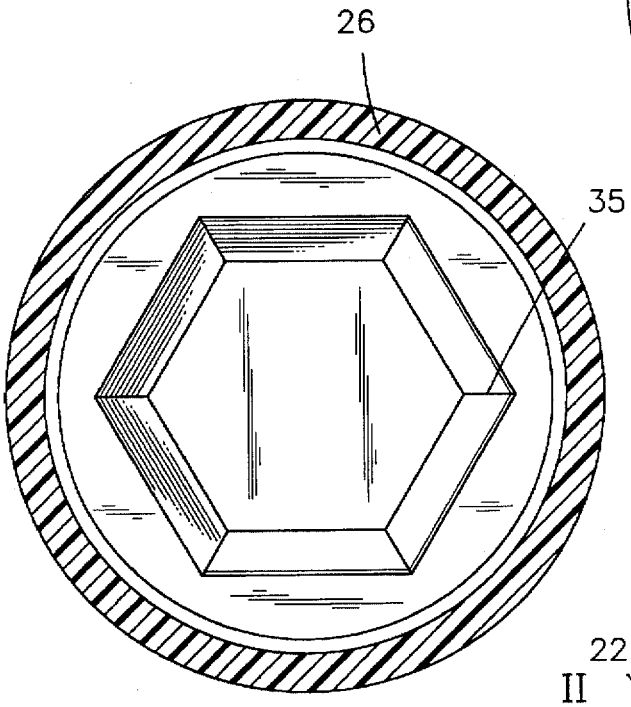
FIG. 2 is a sectional view through line II—II of FIG. 1.

FIG. 3 represents a top view of an injection molded barrier layer 20 of the present invention including a barrier layer rim portion 22 and a barrier layer central portion 23, with brittle interface or weakened portion 30 therebetween. Barrier layer 20 is a generally annular or circular component conforming to the shape of a bottle or container rim portion 14 in order to allow a complete heat seal or welding between the barrier layer rim portion 22 and the container rim 14. As shown in FIG. 2, stepped portion 23A includes corner portions 35 and may be polygonal in cross section, such as the hexagonal configuration in FIG. 2 or the square configuration in FIG. 6. The stepped portion 23A of barrier layer 20 forms a dome-like configuration in FIG. 1. The corresponding stepped portions of the barrier layer and closure member are adjacent one another.

Thus, in accordance with the present invention, removal of the closure member by twisting puts pressure on the corresponding stepped portion of the barrier layer and breaks the seal at the weakened portion, opening the container. It is highly advantageous that the barrier layer remain in place until the closure member is twisted breaking the barrier layer at the weakened portion. Moreover, one can readily determine if the container has been previously opened by determining the integrity of the barrier layer. Thus, for example, one can determine visually through the container or through a transparent closure member if the barrier layer has been broken. Further, removing the closure member breaks the barrier layer audibly so that one can readily hear if the barrier layer is properly broken for the first time by twisting the closure member and removing same as by snapping or twisting. In addition, the container can be reclosed by simply snapping on the closure member, albeit without the integrity of the barrier layer. Naturally, also, a screw closure can be used, if desired.

Figure 5:
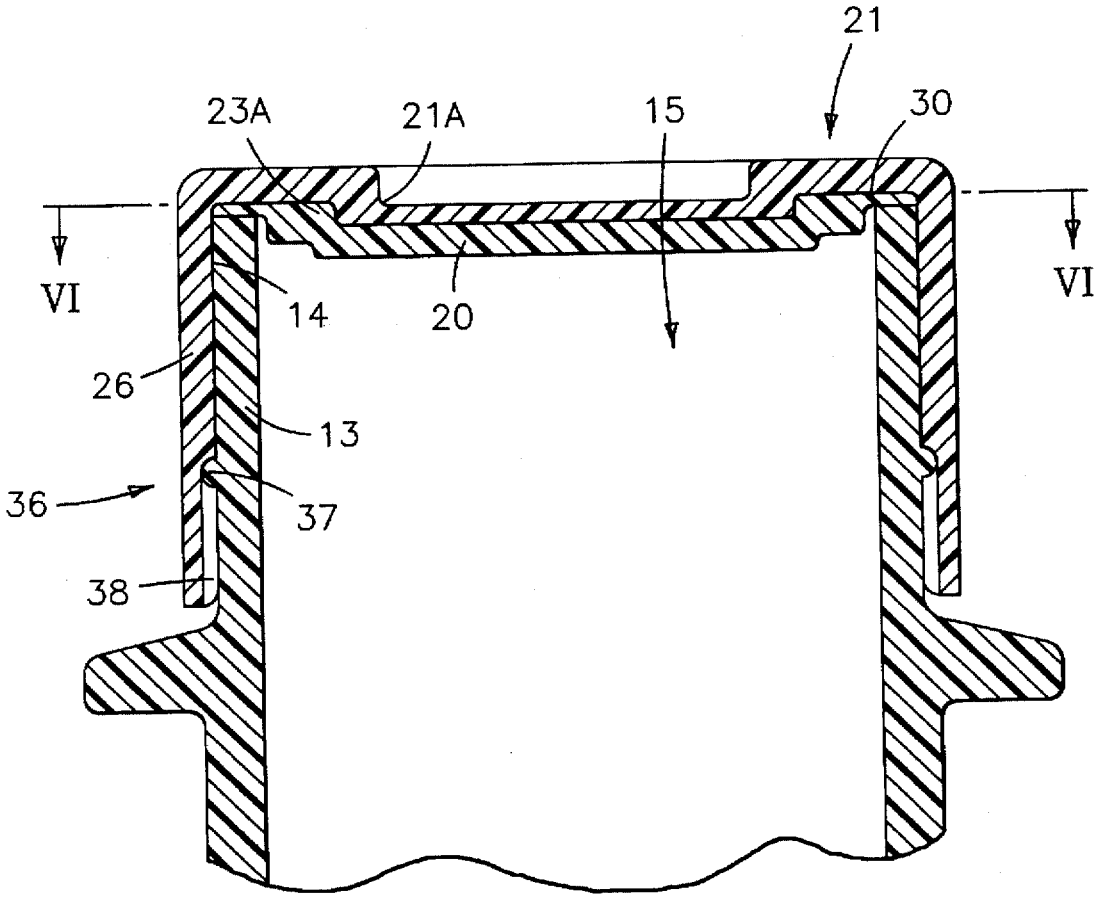
FIG. 5 is a partial sectional side view of an alternate embodiment of a container closure assembly of the present invention.
Figure 6:
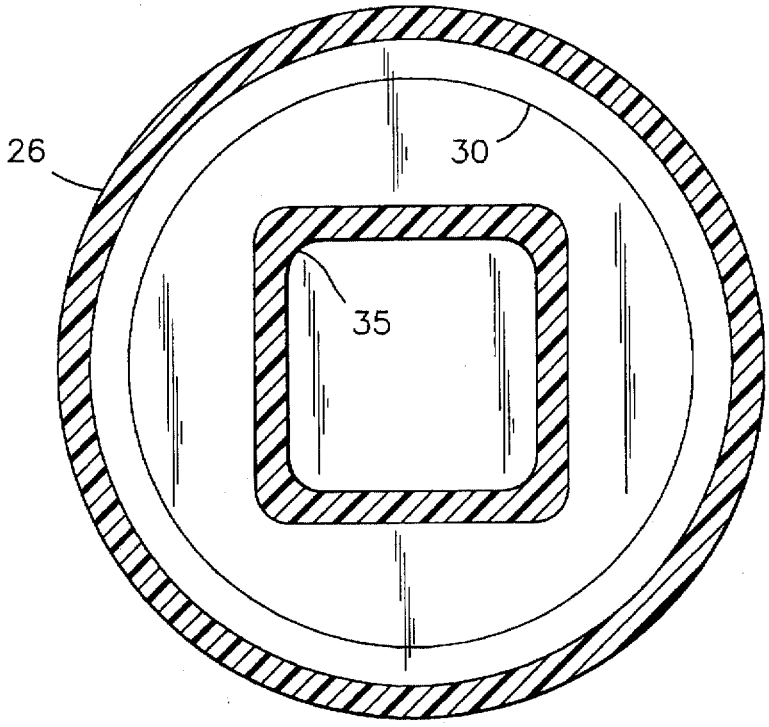
FIG. 6 is a sectional view through line VI—VI of FIG. 5.

FIGS. 5 and 6 represent an alternative embodiment of the present invention wherein the corresponding stepped portions 21A and 23A extend inwardly towards access opening 15. Also, as shown in FIGS. 5 and 6, snap ring 36 is defined by projection 37 on container neck 13 engaging groove 38 on closure member 21 descending leg 26. In the embodiment of FIGS. 5 and 6, weakened portion 30 is defined by a brittle, crystallized zone 30 in barrier layer 20.

Thus, in accordance with the present invention, a container closure assembly is provided which provides a firm barrier layer which is readily opened by simply twisting the closure member. At the same time, the closure assembly provides a tamper evident seal. Further, the closure assembly of the present invention is simple to prepare and use by the consumer.

Figure 7:
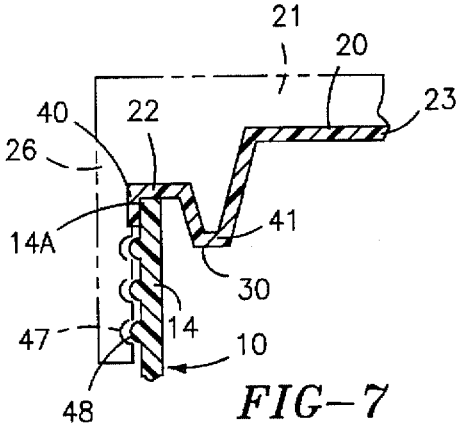
FIGS. 7 and 8 are views similar to FIG. 1 showing an embodiment of the present invention.
Figure 8:
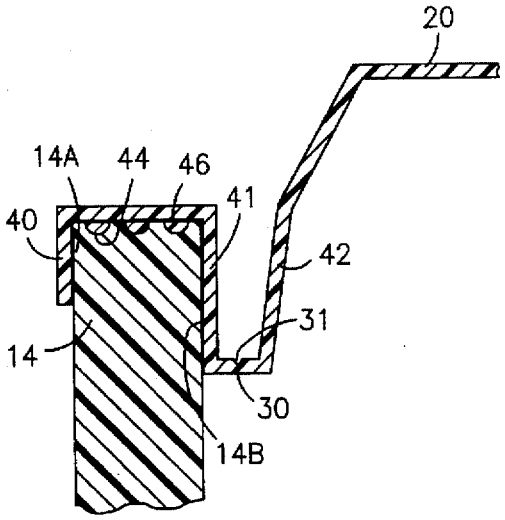

Referring to FIGS. 7 and 8, barrier layer rim portion 23 is hermetically attached to container rim 14 and includes peripheral flange 40 extending downwardly over the outside portion 14A of container rim 14 and if desired adhered thereto. Preferably, the inner surface of barrier layer 20 includes a downwardly descending leg 41 adjacent container rim 14 terminating in weakened portion 30. Desirably, as shown in the enlarged view of FIG. 8, downwardly descending leg 41 contacts inside portion 14B of container rim 14 and is adhered thereto. Upwardly ascending leg 42 of barrier 20 proceeds inwardly of weakened portion 30. The construction of FIGS. 7 and 8 is advantageous as it leaves no sharp protrusions at the container rim where the lips of the user are apt to contact.

The embodiment of FIG. 7 includes mating screw thread member 47 and 48 on closure 21 and container 10 respectively so that the closure is removed by unscrewing.

The gas impervious attachment of the barrier layer and container rim may be accomplished by any desired and convenient means, as by use of an adhesive which may be tacky or heat-setting in preference to dissolved or liquid-dispersed adhesives. Desirably, one may include recesses 44 in container rim 14 to receive adhesive 46 in order to better secure the barrier layer to the container rim. Alternatively, one may simply roughen the top surface of the container rim, i.e., the surface that will contact adhesive 46, or provide it with dimples or protrusions so as to enlarge the available contact area and provide a better seal. This may be accomplished in the injection mold and with a separate tool.

Thus, as previously described, the barrier layer may be advantageously produced by thermoforming into the desired shape, applying a heated notching tool at the location intended to form notches 31 while thermally crystallizing a narrow weakened region 30 adjoining the notch at the same time; applying an adhesive, as by a printing process or by applying adhesive to recesses 44 as well as over the surface of container rim 14.

Thus, in the embodiment of FIGS. 7 and 8, removal of the closure member by unscrewing transmits a torque to the corresponding barrier layer and breaks the seal at the weakened portion 30, opening the container in a manner after the other embodiments.

The closure system in FIGS. 7 and 8 is also tamper proof as in the other embodiments since a positive tearing of the barrier is required for initial opening, which can be readily sensed. Removal of the screw-on closure without having to twist forcefully would show that the barrier had been tampered with.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container closure assembly which comprises: a container having an access opening for the container; a plastic barrier layer having a rim and a central portion completely covering the access opening and with the barrier layer rim portion attached to said container, said barrier layer including a weakened portion in the central portion of the barrier layer, said weakened portion comprising a crystallized brittle portion in a heat treated zone in the barrier layer central portion; a removable closure member adapted to cover said container access opening and barrier layer and engaging said barrier layer, said closure member intimately contacting said barrier layer when said closure member is removed by twisting; whereby removal of the closure member by twisting breaks the barrier layer at the weakened portion and opens the container.

2. A container closure assembly according to claim 1, wherein said barrier layer is polyethylene terephthalate.

3. A container closure assembly according to claim 1, including a notch in the weakened portion.

4. A container closure assembly according to claim 1, wherein the weakened portion has a level of crystallinity in excess of 30%.

5. A container closure assembly according to claim 1, wherein said crystallized brittle portion has a level of crystallinity in excess of 30%.

6. A container closure assembly according to claim 1, wherein said closure is a transparent plastic so that the barrier can be seen through the closure.

7. A container closure assembly according to claim 1, wherein the barrier layer is made of a polymer capable of being crystallized and rendered brittle by said crystallization.

8. A container closure assembly according to claim 1, wherein the closure member and barrier layer include stepped portions adjacent one another over the access opening.

9. A container closure assembly according to claim 8, wherein the stepped portions extend outwardly, away from the access opening.

10. A container closure assembly according to claim 8, wherein the barrier layer stepped portions include corner portions thereof.

11. A container closure assembly according to claim 1, wherein the container includes a container rim, said weakened portion is adjacent said barrier layer rim portion, and the barrier layer rim is adhered to said container rim.

12. A container closure assembly according to claim 11, wherein the container rim surface includes recesses to receive adhesive, and including an adhesive between the container rim and barrier layer.

13. A container closure assembly according to claim 11, wherein said weakened portion is present in a heat treated zone adjacent said barrier layer rim portion.

14. A container closure assembly according to claim 11, wherein said barrier layer includes a downwardly descending leg adjacent the container rim terminating in said weakened portion.

15. A container closure assembly according to claim 14, wherein the downwardly descending leg of the barrier layer contacts an inside portion of the container rim and is bonded thereto.

16. A container closure assembly according to claim 11, wherein said barrier layer rim portion includes a peripheral flange extending downwardly over an outside portion of the container rim.

17. A container closure assembly according to claim 16, wherein the peripheral flange of the barrier layer rim portion is adhered to the outside portion of the container rim.

* * * * *